US008196439B2

(12) United States Patent
Bae et al.

(10) Patent No.: US 8,196,439 B2
(45) Date of Patent: Jun. 12, 2012

(54) LAUNDRY MACHINE INCLUDING A SUPPORT MODULE WITH A DRAWER BASED DETACHABLE WATER SUPPLY

(75) Inventors: Sang Hun Bae, Changwon-Si (KR); Dong Geun Lee, Changwon-Si (KR); Yeon Sik Choi, Changwon-Si (KR); Ju Han Yoon, Changwon-Si (KR)

(73) Assignee: LG Electronics Inc., Seoul (KR)

( * ) Notice: Subject to any disclaimer, the term of this patent is extended or adjusted under 35 U.S.C. 154(b) by 713 days.

(21) Appl. No.: 12/149,467

(22) Filed: May 1, 2008

(65) Prior Publication Data

US 2008/0276661 A1 Nov. 13, 2008

(30) Foreign Application Priority Data

May 2, 2007 (KR) ..... 10-2007-0042698

(51) Int. Cl.
*B08B 3/12* (2006.01)
*F26B 7/00* (2006.01)

(52) U.S. Cl. ..... 68/5 C; 68/5 R; 34/381

(58) Field of Classification Search ..... 68/5 C, 68/5 R; D32/8, 9
See application file for complete search history.

(56) References Cited

U.S. PATENT DOCUMENTS 5,337,703 A * 8/1994 Schlesch et al. ..... 122/379
6,972,397 B2 * 12/2005 Ha ..... 219/401
2005/0115120 A1 * 6/2005 Cevik ..... 38/14
2006/0011071 A1 * 1/2006 Cho et al. ..... 99/417
2006/0117596 A1 * 6/2006 Kim et al. ..... 34/607
2006/0277690 A1 * 12/2006 Pyo et al. ..... 8/149.2

FOREIGN PATENT DOCUMENTS

EP 276458 B * 9/1991

OTHER PUBLICATIONS

EP 276458 Machine Translation.*
EP 276458 Machine Translation Sep. 1991 EPO Horst et al.*

* cited by examiner

*Primary Examiner* — Michael Barr
*Assistant Examiner* — Charles W Kling
(74) *Attorney, Agent, or Firm* — McKenna Long & Aldridge LLP

(57) ABSTRACT

A washing machine is disclosed. A laundry machine includes a drum rotatably provided in a cabinet, a substance supply device to generate water based substance and to supply the water based substance to the drum, a water supply source to supply water to the substance supply device, a pump positioned between the substance supply device and the water supply source, a connection unit to connect the pump with the water supply source, and a supporting module to support the water supply source, the pump and the substance supply device. The connection unit is configured of a coupling member having both opposite ends connected with the water supply source and the pump, respectively, the connection unit formed at a predetermined portion of the supporting module.

7 Claims, 5 Drawing Sheets

LAUNDRY MACHINE INCLUDING A SUPPORT MODULE WITH A DRAWER BASED DETACHABLE WATER SUPPLY

CROSS REFERENCE TO RELATED APPLICATION

This application claims the benefit of the Patent Korean Application No. 10-2007-0042698, filed on May 2, 2007, which is hereby incorporated by reference as if fully set forth herein.

BACKGROUND OF THE DISCLOSURE

1. Field of the Disclosure

The present invention relates to a laundry machine. More particularly, the present invention relates to a laundry machine capable of removing wrinkles from laundry during a drying operation for the laundry, with a compact configuration.

2. Discussion of the Related Art

Typically, a laundry dryer, which is a kind of a laundry machine, is a home appliance used to dry laundry, mainly clothes, completely washed, using hot air. Generally, such a laundry dryer includes a drum for holding laundry to be dried therein, and a drive source for driving the drum, a heater for heating air introduced into the drum, and a blower unit for sucking air into the drum or outwardly discharging air from the drum.

Laundry dryers may be classified into electric type dryers and gas type dryers, based on the type of the system for heating air, namely, the type of the heater. The electric type laundry dryer heats air, using heat generated from an electrical resistance. On the other hand, the gas type laundry dryer heats air, using heat generated in accordance with the combustion of gas.

Laundry dryers may also be classified into condensation type dryers and exhaustion type dryers. In the condensation type dryer, air, which has become humid after being heat-exchanged with laundry to be dried, is circulated without being outwardly discharged. The air is heat-exchanged with ambient air through a separate condenser. In accordance with this heat exchange, condensed water is generated, and is then outwardly discharged. In the exhaustion type dryer, air, which has become humid after being heat-exchanged with laundry to be dried, is directly discharged to the outside of the laundry dryer.

Laundry dryers may also be classified into top loading type dryers and front loading type dryers in accordance with the laundry loading type. In the top loading type dryer, laundry to be dried is loaded into the laundry dryer through the top of the laundry dryer. On the other hand, in the front loading type dryer, laundry to be dried is loaded into the laundry dryer through the front side of the laundry dryer.

Meanwhile, conventional laundry dryers as mentioned above have the following problems.

Typically, in a laundry dryer, laundry spin-dried after being completely washed is loaded so that it can be dried. In this case, the laundry, which has been washed using water, has wrinkles due to the principle of the water washing. In the drying course carried out in the laundry dryer, however, the wrinkles cannot be completely removed. In order to remove the wrinkles still remaining on drying objects, such as laundry, completely dried in conventional drying machines, it is necessary to perform ironing additionally.

There may be wrinkles, rumples or holds (hereinafter, "wrinkles") on laundry in case clothes other than laundry completely washed are stored or used in a typical manner. To this end, it has been required to develop an apparatus capable of conveniently removing wrinkles generated during the storage or use of clothes rather than wrinkles generated during the drying.

SUMMARY OF THE INVENTION

Accordingly, the present invention is directed to a washing machine.

In one aspect, a washing machine is provided to remove and/or prevent wrinkles of laundry.

In another aspect, a washing machine is provided to enhance space usage by a compact structure thereof.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry machine includes a drum rotatably provided in a cabinet; a substance supply device to generate water based substance and to supply the water based substance to the drum; a water supply source to supply water to the substance supply device; a pump positioned between the substance supply device and the water supply source; a connection unit to connect the pump with the water supply source; and a supporting module to support the water supply source, the pump and the substance supply device. The connection unit is configured of a coupling member having both opposite ends connected with the water supply source and the pump, respectively, the connection unit formed at a predetermined portion of the supporting module.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION OF THE ILLUSTRATED EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
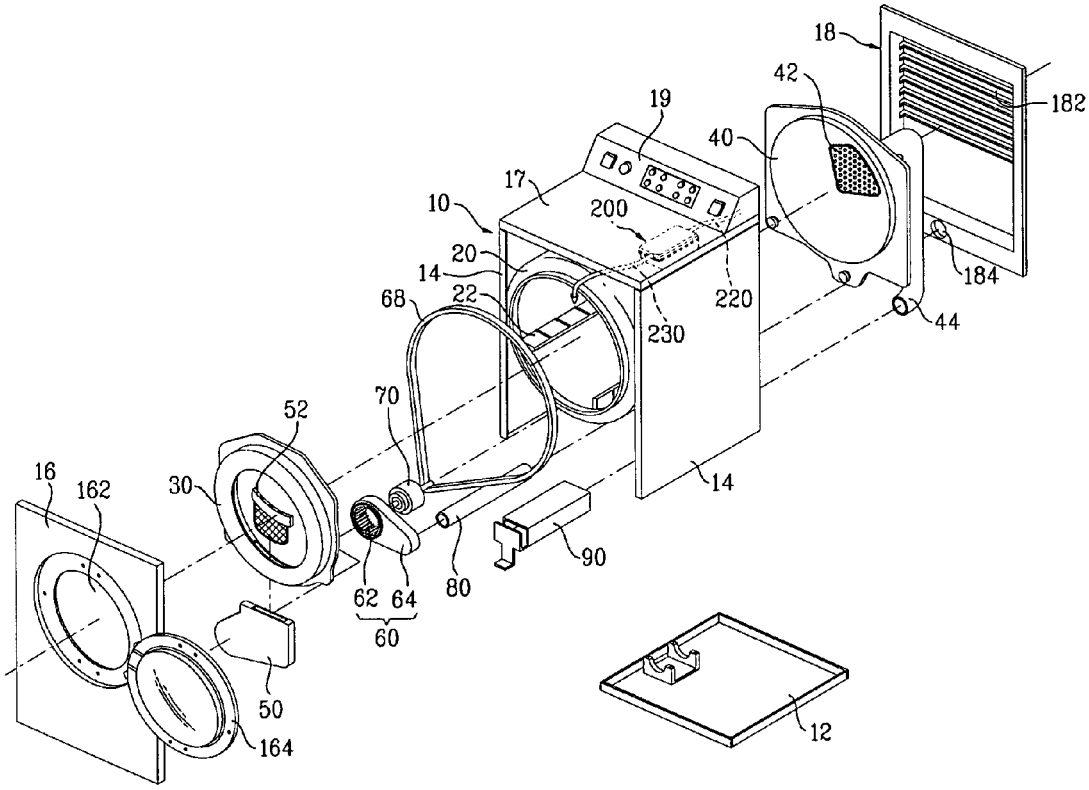
FIG. 1 is an exploded perspective view illustrating a laundry machine according to an exemplary embodiment.

FIG. 1 is an exploded perspective view illustrating an exploded state of a laundry machine according to a preferred embodiment of the present invention. Hereinafter, the laundry machine according to the illustrated embodiment of the present invention will be described with reference to FIG. 1.

A cabinet 10 forms an external appearance of the laundry machine, namely, a laundry dryer, according to the present invention. Various constituent elements of the laundry dryer are arranged in the interior of the cabinet 10. That is, a rotatable drum 20, and a motor 70 and a belt 68, which are adapted to drive the drum 20, may be installed in the cabinet 10. A heater 90 may be arranged in the cabinet 10 at a desired position, to heat air, and thus to generate hot air. A hot air supply duct 44 may also be arranged in the cabinet 10, to supply the hot air generated by the heater 90 to the drum 20. In the cabinet 10, an exhaust duct 80 for exhausting humid air heat-exchanged with objects to be dried in the drum 20, and a blower unit 60 for sucking the humid air may also be arranged. Meanwhile, a substance supply device may be arranged in the cabinet 10 at a desired position, to supply water based substance, e.g. mist or steam to the drum 20.

Although an indirect drive type, in which the motor 70 and belt 68 are used to rotate the drum 20, is illustrated and described in this embodiment, the present invention is not limited thereto. That is, a direct drive type, in which a motor is directly connected to a rear wall of the drum 20, to directly rotate the drum 20, may be applied to the present invention.

Hereinafter, the above-described constituent elements will be described in more detail.

The cabinet 10, which forms the external appearance of the laundry machine, namely, the laundry dryer, may include a base 12 forming a bottom of the cabinet 10, a pair of side covers 14 extending vertically from the base 12, a front cover 16 mounted to the front ends of the side covers 14, a rear cover 18 mounted to the rear ends of the side covers 14, and a top cover 17 disposed on the upper ends of the side covers 14. A control panel 19, which includes various operating switches or the like, may be arranged on the top cover 17 or front cover 16. A door 164 may be mounted to the front cover 16. A louver 182 is provided at the rear cover 18, to introduce ambient air into the cabinet 10. An exhaust hole 184 is also provided at the rear cover 18, as a passage for finally discharging air from the drum 20 to the outside of the drum 20.

The interior of the drum 20 functions as a drying chamber, in which a drying operation is carried out. A lift 22 may be installed in the drum 20, to drop laundry after raising the laundry such that the laundry is turned over, and thus to achieve an enhancement in drying efficiency.

Meanwhile, a front supporter 30 and a rear supporter 40 may be installed between the drum 20 and the cabinet 10, namely, between the drum 20 and the front cover 16 and between the drum 20 and the rear cover 18, respectively. The drum 20 is rotatably installed between the front supporter 30 and the rear supporter 40. Sealing members (not shown) are fitted between the front supporter 30 and the drum 20 and between the rear supporter 40 and the drum 20, respectively, to prevent water leakage. That is, the front supporter 30 and rear supporter 40 close the front and rear ends of the drum 20, to define the drying chamber in the drum 20. The front supporter 30 and rear supporter 40 also function to support the front and rear ends of the drum 20.

An opening may be formed through the front supporter 30, to communicate the drum 20 with the outside of the laundry dryer. The opening is selectively opened or closed by the door 164. A lint duct 50, which is a passage for outwardly discharging air from the drum 20, is connected to the front supporter 30. A lint filter 52 may be installed in the lint duct 50.

One side of the blower unit 60 is connected to the lint duct 50. The other side of the blower unit 60 is connected to the exhaust duct 80. The exhaust duct 80 communicates with an exhaust hole 184 provided at the rear cover 18.

Accordingly, when the blower unit 60 operates, air present in the drum 20 is exhausted from the drum 20 via the lint duct 50, exhaust duct 80, and exhaust hole 184. During this operation, foreign matter such as lint is filtered out by the lint filter 52. Typically, the blower unit 60 includes a blower 62, and a blower housing 64. Typically, the blower 62 is connected to the motor 70, which drives the drum 20.

An opening 42, which is constituted by a plurality of through holes, may be formed through the rear supporter 40. A hot air supply duct 44 may be connected to the opening 42. The hot air supply duct 44 communicates with the drum 20, to function as a passage for supplying hot air to the drum 20. To this end, the air heater 90 may be installed at a certain position in the hot air supply duct 44.

A substance supply device may be installed at a desired position in the cabinet 10, to supply water based substance, e.g. mist or steam to the drum 20. Thus, the substance supply device functions to supply water based substance to the drum 20.

For example, the substance supply device includes a pressure apply device, which applies a certain pressure to water supplied to the drum 20, and thus to supply mist to the drum 20 through a substance supply unit, which will be described later. In this case, the pressure apply device may comprise a separate pump. Alternatively, a water supply line included in the laundry dryer may be directly connected to an external city water tap, to apply water supplied by the water supply line to a certain pressure in accordance with the water pressure from the city water tap. When water is supplied under pressure, it can be sprayed into the interior of the drum 20 through a nozzle or the like included in the substance supply unit, in the form of mist.

Meanwhile, in the illustrated embodiment of the present invention, a steam generator 200 which generates and supplies steam to the interior of the drum 20 functions as the substance supply device. Hereinafter, the steam generator will be described with reference to the accompanying drawings.

Figure 2:
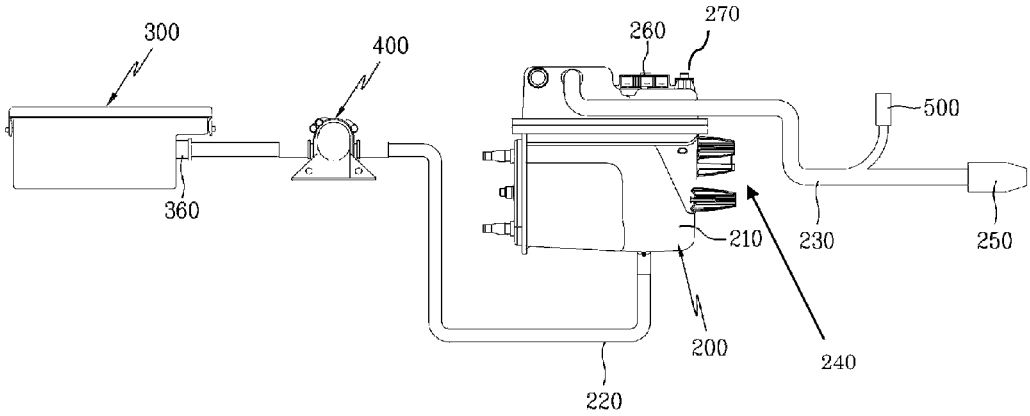
FIG. 2 is a diagram schematically illustrating a cartridge and a steam generator of the washing machine shown in FIG. 1 to supply water.

FIG. 2 schematically illustrates a steam generator provided in the laundry machine according to the embodiment. In reference to FIG. 2, the laundry machine will be explained.

The steam generator 200 includes a water tank 210 for containing water therein, a heater 240 mounted in the water tank 210, a water level sensor 260 for measuring the water level of the steam generator 200, and a temperature sensor 270 for measuring the temperature of the steam generator 200.

Although not shown in the drawings, the water level sensor 260 is configured of a common electrode, a low level electrode and a high level electrode. The water level sensor 260 senses a high level and a low level based on whether an electric current is applied between the common electrode and the high level electrode or between the common electrode and the low level electrode.

A water supply hose 220 is connected to one side of the steam generator 200, to supply water to the steam generator 200 and a steam hose 230 is connected to the other side of the steam generator 200. Here, a nozzle 250 having a predetermined shape is provided at an end of the steam hose 230. Typically, an end of the water supply hose 220 is connected to a water supply source such as a cartridge 300 and an end of the steam hose 230 or the nozzle, namely, a steam outlet is positioned at a desired position in the drum 20 to spray steam into the drum 20.

The water supply source may be configured of the cartridge 300 that is detachable according to this embodiment. However, the water supply source may be configured of an external city water tap. If the water supply source is configured of the water tap, the installation might be complex. This is because water is not used in a laundry dryer. Specifically, if the water tap is used as the water supply source, it is necessary to install corresponding additional units. As a result, the detachable water supply source 300 is provided and water is supplied to the detached water supply source such that the water supply source filled with water is connected to a water supply path of the steam generator 200, namely, the water supply hose 220, which is quite convenient to a user.

A pump 400 is provided between the water supply source 300 and the steam generator 200. The pump is rotatable in a clockwise and counter-clockwise direction and here it is preferable that the pump is capable of draining remaining water of the steam generator 200 as necessary. The reason why the remaining water is drained is that the heater of the steam generator could be damaged by the remaining water or that contaminated water could be used later if the steam generator is not used for quite a long time. In addition, a safety valve 500 is provided at a steam path for discharging steam, namely, the steam hose 230.

Next, in reference to the corresponding drawings, it will be described that the steam generator of the laundry machine is installed at the cabinet.

Figure 3:
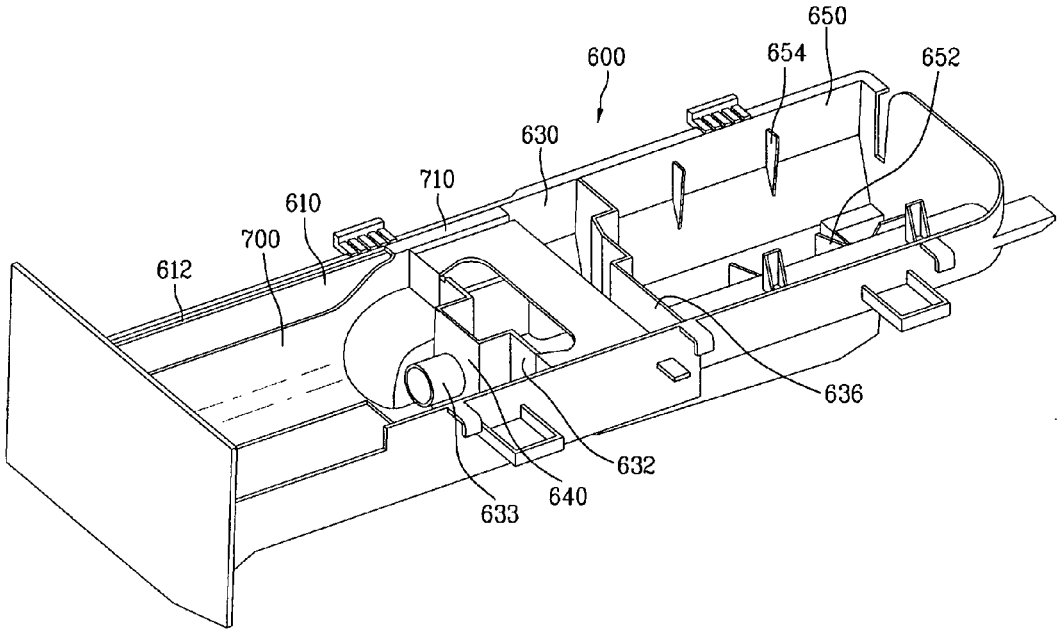
FIG. 3 is a perspective view illustrating a supporting module provided in a washing machine according to another embodiment.

FIG. 3 is a perspective view illustrating a supporting module where the steam generator is mounted according to another embodiment.

In reference to FIG. 3 the laundry machine according to this embodiment may include a drawer 700 detachable from the cabinet (10, see FIG. 1) and the cartridge 300 may be selectively mounted to the drawer 700. That is, the drawer 700 is drawable from the cabinet 10 and the cartridge 300 is mounted in the drawer 700, rather than the cartridge 300 being directly installed at the cabinet 10.

It may increase the number of the works and the time only to deteriorate productivity efficiency to install the above various constituent elements for supply water based substance, e.g. mist or steam, for example, the cartridge, the pump, the steam generator and the like in the laundry machine separately. Thus, in this embodiment, instead of installing the constituent elements in the laundry machine separately, the various constituent elements are fabricated to form a single module and the single module is installed in the laundry machine to save the product processes and the time. Next, in reference to FIG. 3, the module will be described in detail.

The laundry machine according to this embodiment may include a supporting module 600. In case the drawer 700 is drawable inward or outward, the supporting module 600 may guide the motion of the drawer 700 and support the steam generator (200, see FIG. 2) such that the supporting module 600 may be installed at a desired position of the cabinet 10, namely, a front of the cabinet 10. As mentioned above, the supporting module 600 may guide the motion of the drawer 700 and support the steam generator 200.

More specifically, the supporting module 600 has a hexahedron appearance with an open top and it may be formed as a single member. Since the supporting module 600 is formed of a single member as one body, it is easy to fabricate the supporting module 600 and it is convenient to assemble various constituent elements which will be described later. This supporting module 600 may include a drawer guide part 610 for guiding the motion of the drawer 700 and a steam generator securing part 650 for securely supporting the steam generator 200.

As shown in FIG. 3, the drawer guide part 610 may be formed at a front portion of the supporting module 600 and thus the drawer 700 is drawable inward and outward through the open side of the drawer guide part 610. The interior of the drawer guide part 610 may have an appearance corresponding to the exterior appearance of the drawer 700. For example, as shown in FIG. 3, if the drawer 700 is formed in a hexahedron shape having an open upper side, the interior appearance of the drawer guide part 610 is correspondingly formed in a hexahedron shape having an open upper side.

In addition, a guide prominence 612 is formed at both opposite inner surfaces of the drawer guide part 610 and a projection 710 corresponding to the guide prominence 612 is formed at both opposite sides of the drawer 700. As the projection moves along the guide prominence 612, the motion of the drawer 700 may be guided.

The steam generator securing part 650 may be formed at a rear portion of the supporting module 600. The steam generator 200 is securely mounted at the steam generator securing part 650. Specifically, plural supporting ribs 652 may be formed at a lower portion of the steam generator securing part 650 to support the steam generator 200 and plural securing ribs 654 may be formed at both opposite side surfaces of the steam generator securing part 650.

In this case, the distance between the securing ribs 654 formed at the side surfaces may be corresponding to the width of the steam generator 200. As a result, if the steam generator 200 is mounted at the steam generator securing part 650, a lower portion of the steam generator 200 is supported by the supporting ribs 652, while both side portions of the steam generator 200 is secured by the securing ribs 654.

Although not shown in the drawings, the steam generator 200 may be secured to the steam generator securing part 650 by a securing member such as a bolt. The securing member may be fastened to the steam generator 200 via the lower portion or the side portion of the steam generator securing part 650 to secure the steam generator 200.

When the drawer 700 having the cartridge 300 mounted therein is drawable inward and outward along the drawer guide part 610 and the steam generator 200 is secured to the steam generator securing part 650, the pump 400 may be provided between the cartridge 300 and the steam generator 200 as mentioned above.

In this case, the supporting module 600 may further include a pump securing part 630 provided between the drawer guide part 610 and the steam generator securing part 650. The pump 400 may be secured at the pump securing part 630.

Specifically, the pump securing part 630 may be formed between the drawer guide part 610 of the supporting module 600 and the steam generator securing part 650. A first rib 632 may be formed between the drawer guide part 610 and the pump securing part 630. A second rib 636 may be formed between the pump securing part 630 and the steam generator securing part 650, such that the pump securing part 630 may be partitioned.

The pump 400 may be secured to the pump securing part 630 and it may be connected to the cartridge 300 by a connection unit formed at the first rib 632. That is, when the cartridge 300 is mounted in the drawer 700 and the drawer 700 is drawn inward, the drawer 700 may move along the drawer guide part 610. Hence, when a side of the moving drawer 700 reaches the first rib 632 formed at the rear portion of the drawer guide part 610, the cartridge 300 mounted in the drawer 700 is connected with the pump 400 via the connection unit. The connection unit will be described later.

As a result, the water of the cartridge 300 may be supplied to the steam generator 200 by the operation of the pump 400. If trying to supply all of the water within the cartridge 300 to the steam generator 200 or to replace the water within the cartridge 300 with clean water, a user draws the drawer 700 outward to be detached to separate the cartridge 300 and then supplies water to the cartridge 300.

The first and second rib 632 and 636 may be formed across the supporting module 600. As mentioned above, the first and second rib 632 and 636 may function to partition the supporting module 600 into the drawer guide part 610, the pump securing part 630 and the steam generator securing part 650 and to cover the various sub-electric assemblies mounted on the supporting module 600 from being exposed outside.

Specifically, in the supporting module 600 may be arranged various elements including the pump 400 and the steam generator 200 and various wires for connecting the elements with each other. Without the first and second rib 632 and 636, the elements and wires may be seen outside when the drawer 700 is detachably drawn outward, which may deteriorate exterior beauty and cause failures of the elements and wires only to injure the user.

Thus, according to the laundry machine of this embodiment, the first and second rib 632 and 636 may be provided at the supporting module 600 not to expose the various mounted elements and wires outside. In this case, it is possible to install only the first rib 632 and it is preferable that the second rib 636 is further provided to prevent them from being exposed outside in a double structure.

Meanwhile, the washing machine having the separate pump as the pressure apply device may include a different type of a supporting module. Namely, the supporting module may not include a steam generator securing part. In this case, the connection unit may connect the water supply device with the pump which applies a predetermined pressure to water supplied from the water supply device.

Figure 4:
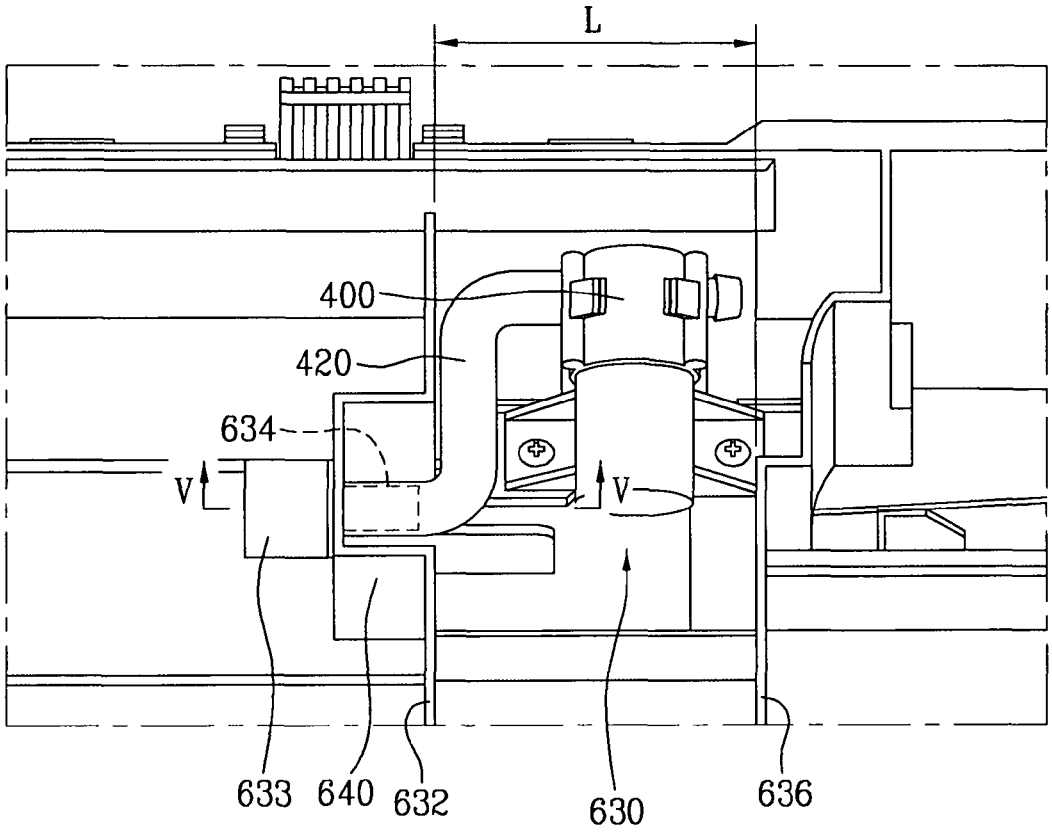
FIG. 4 is a perspective view partially illustrating a pump fixing part of the supporting module of FIG. 3.

The pump securing part 630 is illustrated in FIG. 4 in detail.

In reference to FIG. 4, the pump 400 may be secured to the pump securing part 630. The pump 400 may be connected with the water supply source by a pump water supply hose 420 and the connection unit. In this embodiment, the connection unit for connecting the cartridge 300 with the pump 400 may include a first coupling member 633 and a second coupling member 634 which are formed at the first rib 632 in communication with each other.

The first coupling member 633 may extend toward the drawer guide part (610, see FIG. 3) from the first rib 632 and the second coupling member 634 may extends toward the pump securing part 630 in communication with the first coupling member 633.

That is, the first and second coupling member 633 and 634 may extend from the first rib 632 and they are in communication with each other. As mentioned above, the drawer 700 is drawn inward along the drawer guide part 710, a connection portion 360 of the cartridge (300, see FIG. 2) is connected with the first pipe 633 and the pump water supply hose 420 is connected with the second coupling member 634, such that the water of the cartridge 300 may be supplied to the pump 400.

According to the embodiment, an inner space of the laundry machine is limited. The space is limited when the above-mentioned constituent elements being installed and thus it is preferable that a volume of each element is reduced as much as possible. As a result, if the drawer 700, the pump 400 and the steam generator 200 are supported by the supporting module according to this embodiment, it is preferable that a volume of the supporting module 600 is also reduced.

There may be various kinds of ways to reduce the volume of the supporting module. As shown in FIG. 4, it can be an example that a length (L) of the pump securing part 630. If the length (L) of the pump securing part 630 is reduced, it is difficult to connect the pump water supply hose 420 to the second coupling member 634. that is, to connect the pump water supply hose 420 with the second coupling member 634, a length of the second coupling member 634 where the pump water supply hose 420 is inserted should be more than a predetermined value. Then, a fastening length may be secured if a clamp (not shown) is fastened.

However, if the length (L) of the pump securing part 630 is reduced to reduce the volume of the supporting module, the length of the second coupling member 634 where the pump water supply hose 420 is inserted is shortened and the fastening length may not be secured.

However, according to this embodiment, the connection unit may be provided. Because of the connection unit, the fastening length for the clamp may be secured, even though the length (L) of the pump securing part 630 may be reduced, which will be described in reference to the corresponding drawings.

As mentioned above, the connection unit according to this embodiment may include the first coupling member 633 and the second coupling member 634 in communication with each other. Specifically, the first coupling member 633 may be formed at the first rib 632 to be connected with the cartridge 300 selectively. The second coupling member 634 extends toward the first coupling member 633, in communication with the first coupling member 633.

The second coupling member 634 may extend toward the first coupling member 633 to a predetermined length to secure the fastening length of the clamp when connecting the pump water supply hose 420 with the second coupling member 634.

Figure 5:
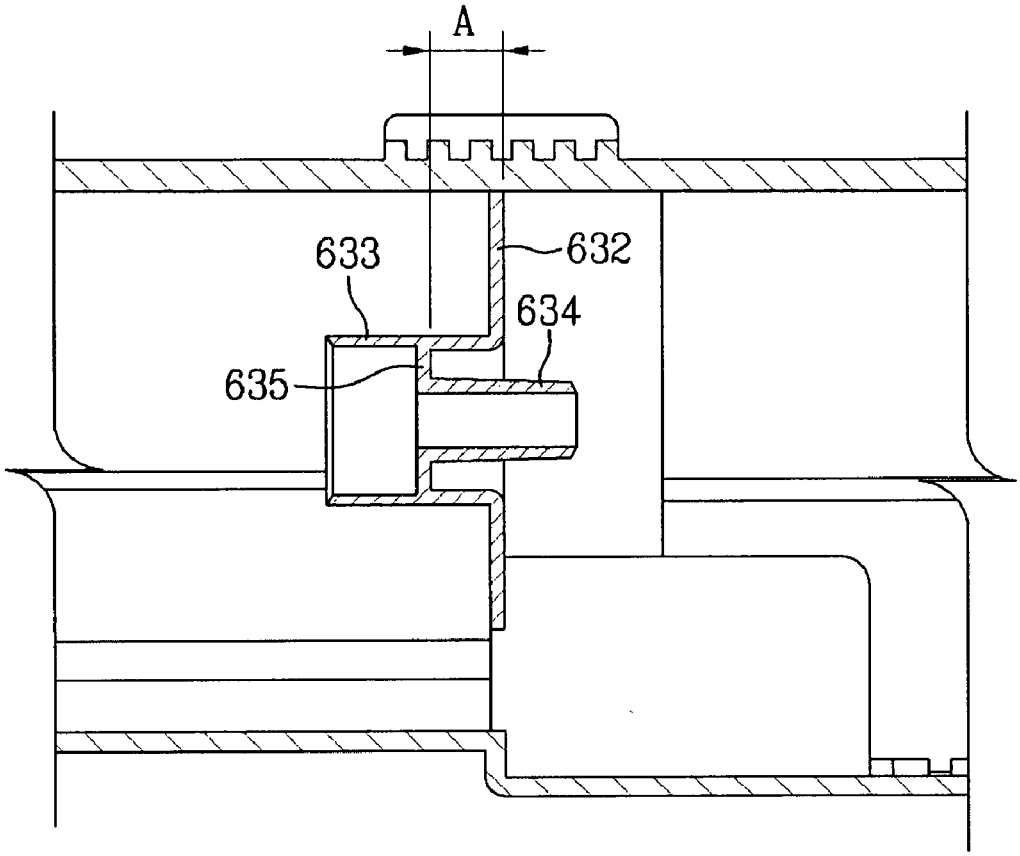
FIG. 5 is a sectional view in accordance with V-V line of FIG. 4.

Such a configuration of the second coupling member 634 is shown in FIG. 5 in detail and here FIG. 5 is a sectional view along a V-V line of FIG. 4.

In reference to FIG. 5, a partition wall 635 is provided at the first coupling member 633 and the second coupling member 634 may extend from the partition wall 635 toward the pump securing part (630, see FIG. 4). As shown in FIG. 5, the partition wall 635 may be spaced apart a predetermined distance from an end of the first coupling member 633 toward the pump securing part 630 along the first coupling member 633. The second coupling member 634 may extend toward the pump securing part 630 from the partition wall 635, not from the surface of the first rib 632.

As a result, the second coupling member 634 of this embodiment may secure the length as long as "A" of FIG. 5, compared with the case of the second coupling member formed along the surface of the first rib 632 and thus the fastening length for the clamp fastening may be secured. If the pump water supply hose 420 is connected with the second coupling member 634, the connection portion between the pump water supply hose 420 and the second coupling member 634 may be long as much as "A" portion and thus it is possible to secure the pump water supply hose 420 to the second coupling member 634 more smoothly.

The first and second coupling member 633 and 634 according to this embodiment may be formed along the flat first rib 632. However, as shown in FIG. 4, it is preferable that the first and second coupling member 633 and 634 are formed at the protrusion 640 projected from the first rib 632.

The protrusion 640 may be projected toward the drawer guide part 610. If the first and second coupling member 633 and 634 are formed at the protrusion 640, it is possible to connect the pump water supply hose 420 to the second coupling member 634 smoothly. That is, since the protrusion 640 is projected toward the drawer guide part 610 from the pump securing part 630, the length of the second coupling member 634 may extend as long as the projected length of the protrusion 640.

If the length (L) of the pump securing part 630 is reduced without the protrusion 640 in FIG. 4, it is limited to lengthen the second coupling member 634. This is because the pump water supply hose 420 is bent and the space for the bent portion should be secured.

In this embodiment, the protrusion 640 is formed at the first rib 632 and the first and second coupling member 633 and 634 are formed at the protrusion 640. As a result, it is possible to lengthen the second coupling member 634 as much as the length of the protrusion 640. the connection portion between the pump water supply hose 420 and the second coupling member 634 may be lengthened as much as the increased length of the second coupling member 634, such that the connection may be more secure.

The second coupling member 634 may extend from the partition wall 635 spaced apart a predetermined distance from the end of the pump securing part 630 along the first coupling member 634. Since the first and second coupling member 633 and 634 may be formed at the protrusion 640 of the first rib 632, the length of the second coupling member 634 is increased as much as the length of "A" of the partition wall 635 spaced apart from the end of the first coupling member 633 and as the projected length of the protrusion 640. The connection portion between the pump water supply hose 420 and the second coupling member is lengthened as much as the lengthened portion of the second coupling member 634, such that it is possible to connect the pump water supply hose 420 with the second coupling member more easily and smoothly.

Next, an operation of the laundry machine having the above configuration will be described.

First, the user separates the cartridge 300 from the cabinet 10 and fills the cartridge 300 with water. Then, the user mounts the cartridge 300 to the cabinet again, before operating the laundry machine.

Hence, if the laundry machine is operated to supply steam, the water is supplied to the steam generator 200 from the cartridge 300 by the operation of the pump 400. The water is heated and steam is supplied to the drum 20.

The embodiments of the present invention may be described in reference to the front loading type laundry machine in which laundry is loaded through the front of the laundry machine and the embodiments are not limited thereto. The embodiments may be applicable to the top loading type in which laundry is loaded through the top of the laundry machine.

On the other hand, the embodiments are described in reference to the cartridge 300 configured as the water supply source, which is detachable from the cabinet 10 and the embodiments are not limited thereto. The embodiments may be applicable to a fixed water supply source.

The laundry machine according to the above embodiments has following advantageous effects.

As mentioned above, according to the laundry machine, steam is sprayed to the laundry completely dried and wrinkles that might be generated on the laundry may be removed without additional ironing.

Furthermore, the length of the second coupling member connected with the pump water supply hose of the pump is increased. As a result, the second coupling member may be connected with the pump water supply hose more smoothly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A laundry machine, comprising:

a drum rotatably provided in a cabinet;

a steam generator to generate and supply the steam to the drum;

a water supply source detachable provided at a drawer drawable inward and outward in a predetermined portion of the cabinet;

a connection unit connecting the steam generator with the water supply source;

a pump connected with the water supply source by the connection unit and supplying water to the steam generator; and a supporting module supporting the water supply source including the drawer, the pump and the steam generator, wherein the connection unit comprises a coupling member having both opposite ends connected with the water supply source and the pump, respectively, wherein the supporting module comprises:

a drawer guide part guiding the inward and outward motion of the drawer, a pump securing part partitioned from the drawer guide part by a first rib, the pump securing part in which the pump is secured, and a steam generator securing part in which the steam generator is secured; and wherein the coupling member is configured to pass through the first rib.

2. The laundry machine of claim 1, further comprising:

a heater heating air to supply hot air to the drum.

3. The laundry machine of claim 1, wherein the connection unit is formed at a predetermined portion of the supporting module.

4. The laundry machine of claim 1, wherein the coupling member comprises, a first coupling member formed toward the drawer guide part from the first rib, selectively connected with a water supply device of the drawer; and a second coupling member extended toward the pump securing part to be connected with the pump, the second coupling member in communication with the first connection pipe.

5. The laundry machine of claim 4, wherein a partition wall is provided inside the first coupling member and the second coupling member is extended toward the pump securing part from the partition wall.

6. The laundry machine of claim 5, wherein the first coupling member and the second coupling member are formed at a protrusion formed at the first rib.

7. The laundry machine of claim 6, wherein the protrusion is projected toward the drawer guide part from the first rib.

* * * * *